US005460556A

United States Patent [19]

Logan et al.

[11] Patent Number: 5,460,556

[45] Date of Patent: Oct. 24, 1995

[54] VARIABLE BUOYANCY BUOY

[75] Inventors: Denis J. Logan, Melville; Raymond W. Vopat, Flushing, both of N.Y.

[73] Assignee: Loral Corporation, New York, N.Y.

[21] Appl. No.: 176,009

[22] Filed: Dec. 30, 1993

[51] Int. Cl.[6] ..... B63B 22/06

[52] U.S. Cl. ..... 441/2; 441/21; 441/32

[58] Field of Search ..... 114/315; 441/1, 441/2, 3, 6, 7, 10, 21, 22, 23, 28, 29, 32

[56] References Cited

U.S. PATENT DOCUMENTS

| | | | |
|---|---|---|---|
| 2,718,016 | 9/1955 | Henke | 441/6 |
| 3,189,922 | 6/1965 | Margot et al. | 441/29 |
| 3,257,672 | 6/1966 | Meyer et al. | 441/29 |
| 3,520,263 | 7/1970 | Berry et al. | 441/29 |
| 3,631,551 | 1/1972 | Miller | 441/29 |
| 3,680,160 | 8/1972 | Heikki | 441/29 |
| 5,073,136 | 12/1991 | De Witt et al. | 441/21 |

*Primary Examiner*—Stephen Avila
*Attorney, Agent, or Firm*—Seymour Levine; Stanton D. Weinstein

[57] ABSTRACT

A variable buoyancy buoy includes a shell and expansion apparatus. The two are combined in a manner to provide a watertight structure with an internal region wherein a constant pressure is maintained that is substantially equal to the pressure at a predetermined depth below the water surface. At depths above the predetermined depth the internal pressure is greater than the external water pressure. This differential pressure causes the buoy to expand, thereby increasing its buoyancy.

4 Claims, 3 Drawing Sheets

VARIABLE BUOYANCY BUOY

BACKGROUND OF THE INVENTION

1. Field Of The Invention

The invention pertains to the field of buoyant objects and more particularly to a buoy with a variable buoyancy.

2. Background Of The Invention

Submerged vehicles often have a need for above surface communications. Such a need, for example, exits when the submerged vehicle does not know its exact location and wishes to access the Global Positioning System satellite to obtain a position fix. To establish a communication link with the satellite it is necessary for the submerged vehicle to send an antenna to the surface with a link to the submerged vehicle. This is accomplished by placing the antenna in a buoy having sufficient buoyancy to ascend to the surface. These buoys are relatively large and, when stored in the cramped submerged vehicle, occupy much needed space.

An alternative to storing the buoy in the vehicle is to tow the buoy at the end of a tether coiled within the vehicle. As the tether is uncoiled the buoy commences its ascent to the surface. The size of the buoy, however, generates appreciable drag on the vehicle, seriously effecting its maneuverability.

It is an objective of the current invention to provide a buoy with variable buoyancy which is sufficiently compact at the submerged depth of the vehicle to permit convenient internal storage, or if towed to present little drag on the vehicle.

SUMMARY OF THE INVENTION

In accordance with the principles of the present invention a variable buoyancy buoy includes a rigid shell and an elastic collar attached to the shell about a perforated region. An inert gas, at a pressure substantially equal to the water pressure at a predetermined depth, which may be the launch depth of the buoy, fills the internal regions of the shell. At the predetermined depth the buoy is self-buoyant and the elastic collar is deflated to fit snugly about the outer surface of the shell. At this depth the buoy is compact and may be easily stored or towed with little drag. When the buoy is launched it begins to rise, slowly at first. As it ascends, the decease in water-pressure permits the gas to flow through the perforations from the internal region of the shell and inflate the elastic collar, increasing the buoyancy of the buoy and the rate of ascent. The internal pressure of the gas continues to inflate the elastic collar as the buoy ascends and the water pressure continues to decrease, until the buoy reaches the water's surface. At the surface the buoy has sufficient buoyancy to provide the hydrodynamic stability and wave following required for the surface communication activity.

In a second embodiment, the buoy shell is in two parts which are coupled in a watertight manner through a bellows. The internal region of the shell and bellows is filled with an inert gas at a pressure substantially equal to the pressure at a predetermined launch depth, as in the first embodiment. At the predetermined depth the bellows is compressed and the two parts come together, thereby creating a compact package for storage within the submerged vehicle or for towing with little drag.

When the buoy is launched it begins to rise, slowly at first, as does the first embodiment. As the buoy rises the water pressure decreases permitting the gas to expand and concomitantly expanding the bellows, thereby increasing the size of the buoy and its buoyancy. The buoyancy of the buoy continues to increase as the buoy ascends due to the decrease in water pressure which creates an increase in the differential pressure between the external water pressure and the internal gas pressure. The differential pressure and the buoyancy of the buoy continues to increase until the buoy achieves the water's surface, whereat it has sufficient buoyancy to provide the hydrodynamic stability and the wave following required for the communication function.

DESCRIPTION OF THE PREFERRED EMBODIMENTS

Figure 1:
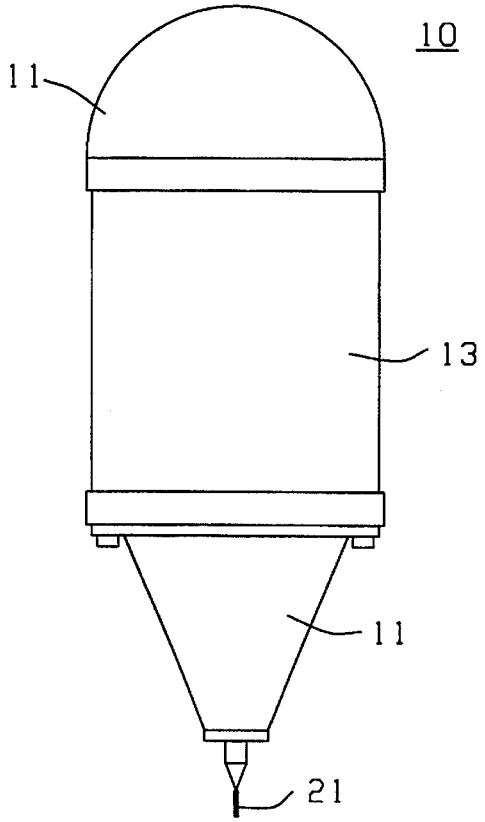
FIG. 1 is a view of a preferred embodiment of the invention.
Figure 2:
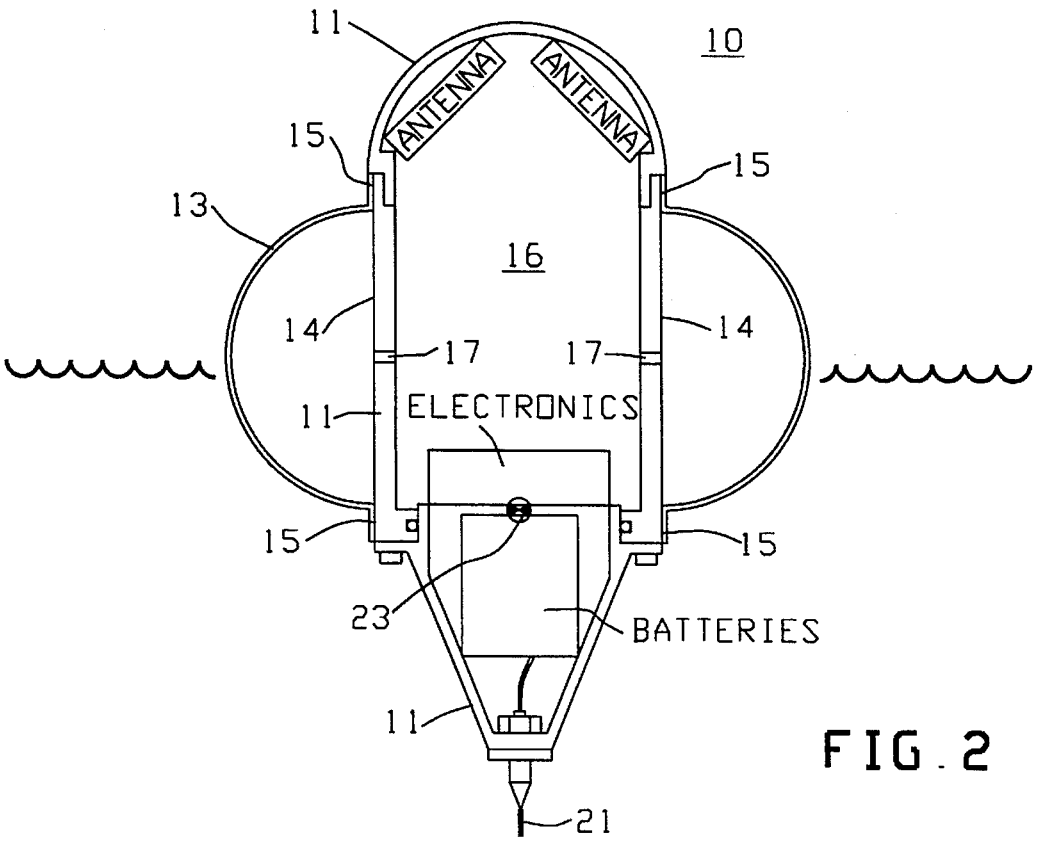
FIG. 2 is a cross-sectional view of the embodiment shown in FIG. 1.

Refer now to FIGS. 1 and 2, wherein views of a first preferred embodiment of the invention are shown. A variable buoyancy buoy 10, to be launched at a predetermined depth, includes a shell 11, which may be constructed of carbon composite material, and an elastic collar 13, which may be constructed of material such as rubber, attached to the outer surface 14 of the shell 11 in a manner to establish a watertight seal 15. The interior region 16 of the shell 11 is filled with an inert gas such as dry nitrogen. Perforations 17, circumferentially positioned, are provided in the shell 11, in a region of the shell covered by the collar 13, for reasons to be explained. It will become apparent, however, that the positioning of the perforations can be other than circumferential and may be arranged randomly in the region covered by the elastic collar 13. A tether 21, is attached to the buoy 10.

The inert gas fills the region 16 at a pressure that is substantially equal to the external water pressure at or above the launch depth of the buoy. Prior to being launched, the tether 21 is coiled within the submerged launching vehicle and external pressure on the outer surface of the variable buoyancy buoy is greater than the internal gas pressure, establishing a differential pressure which causes the elastic collar 13 to fit tightly about the shell 11. When the variable buoyancy buoy 10 is launched, the tether 21 is paid out freely. At launch the variable buoyancy buoy is initially self buoyant and it begins to rise, slowly at first. As it rises the internal gas pressure becomes greater than the external water pressure, thereby creating a pressure differential between the internal region 16 and the external water pressure that causes the inert gas to flow through the perforations 17 and start to inflate the elastic collar 13. This elastic collar inflation increases the buoyancy of the buoy 10 and it rises still further, thereby increasing the pressure differential and causing the elastic collar to inflate still further. The increase in differential pressure and elastic collar inflation continues until the variable buoyancy 10 reaches the water's surface whereat the elastic collar has achieved a predetermined diameter. Ballast within the buoy establish a center of gravity 23 which, coupled with the surface buoyancy of the variable buoyancy buoy 10, creates a stability that permits the buoy to follow the waves with a predetermined orientation.

When the tether 21 is recoiled in the submerged vehicle, the buoy is pulled beneath the surface. This causes a decrease in the differential pressure between the internal inert gas pressure and the external water pressure. The decreased differential pressure produces a deflation of the elastic collar 13 that further decreases the buoyancy of the buoy 10, thus permitting the tether to draw it further beneath the surface with a minimum of exerted force. As the buoy descends, the deflation of the collar continues. At the predetermined depth the collar 17 is completely deflated and fits tightly about the shell 11.

Figure 4:
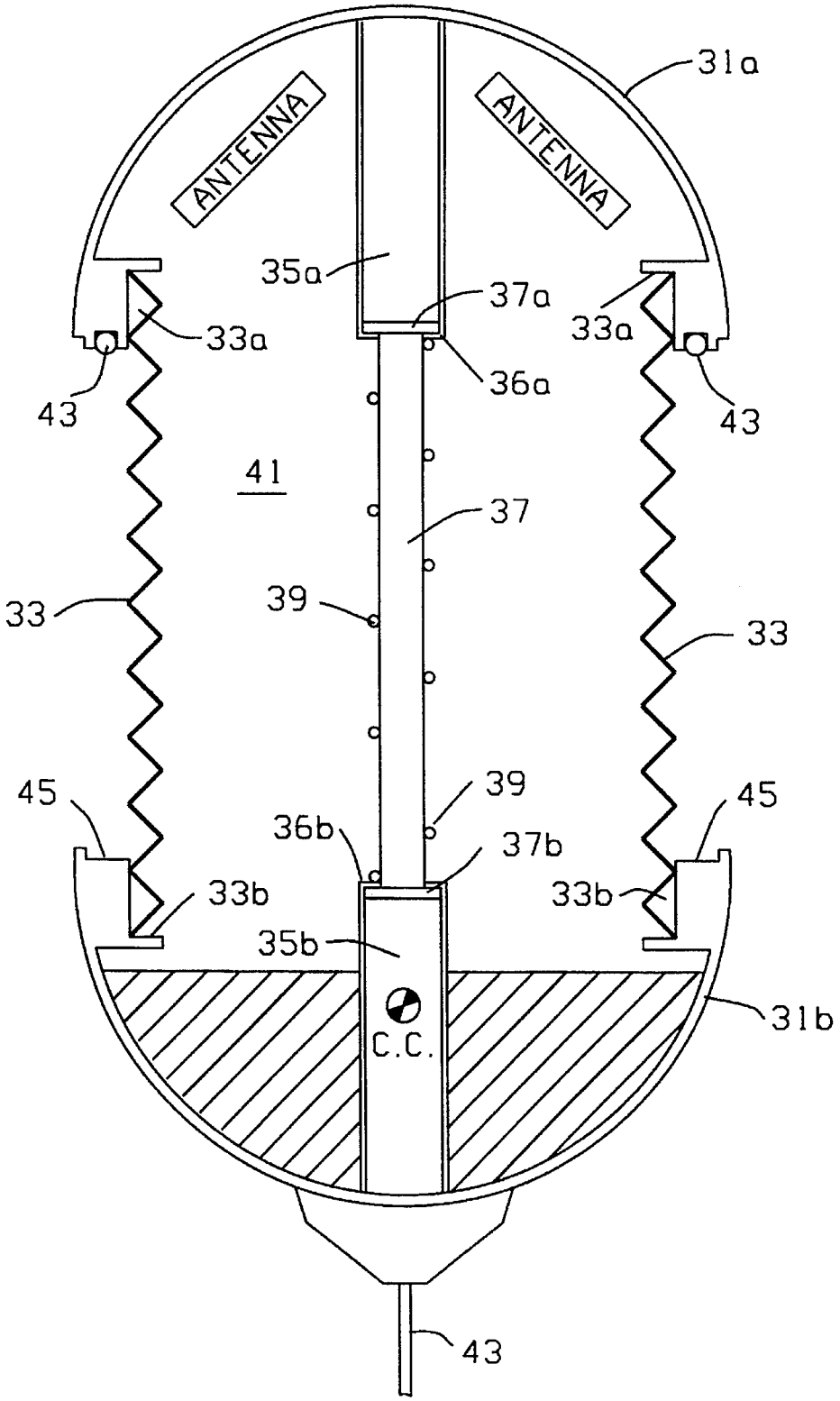
FIG. 4 is a cross-sectional view of the embodiment shown in FIG. 3.

Refer now to FIGS. 4 and 5, wherein a second preferred embodiment of the invention is shown. In these figures like elements are assigned the same reference number. A variable buoyancy buoy 30 in accordance with the second preferred embodiment includes a shell 31 having first and second halves 31*a* and 31*b* and a bellows 33, connected to the two parts of the shell 31*a* and 31*b* at 33*a* and 33*b*, respectively, in a manner to form a watertight seal. The shell 33 may be made of a corrosion resistant material such as stainless steel, aluminum or titanium, while the bellows may be made of a material such as beryllium copper, or stainless steel. Two channels 35*a* and 35*b* extend from the inner surfaces of sections 31*a* and 31*b*, respectively. A rod 37, having first and second ends 37*a* and 37*b*, captured by lips 36*a* and 36*b* on the channels 35*a* and 35*b*, respectively, is constructed to slide in the two channels. A spring 39, respectively restrained at its ends 39*a* and 39*b* by the lips 36*a* and 36*b* is wrapped around the rod. A region 41 formed internal to the shell and bellows assembly is filled with an inert gas, such as dry nitrogen.

Figure 3:
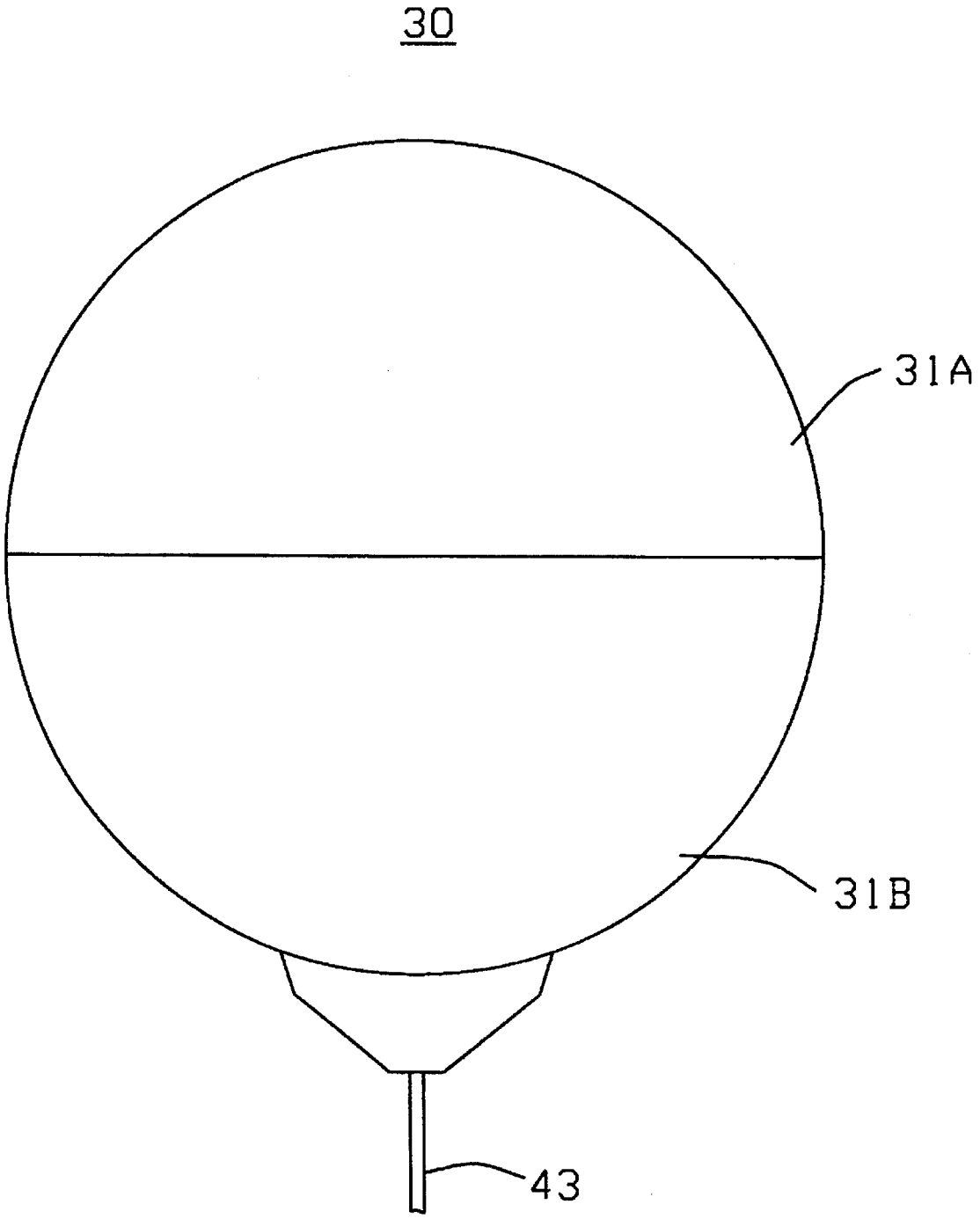
FIG. 3 is a view of a second preferred embodiment of the invention.

The gas fills the region 41 at a pressure which is substantially equal to the pressure at a predetermined launch depth for the buoy. At the predetermined launch depth the external water pressure causes the bellows 33, spring 39, and inert gas to compress so that the two halves 31*a* and 31*b* of the shell are brought together, as shown in FIG. 3. Below the predetermined depth, a watertight seal is formed by an "O" ring 43 compressed on a sealing surface 45.

When the variable buoyancy 30 is launched, it is self buoyant and begins to ascend attached to a tether. As the buoy ascends the water pressure decreases. This decrease in water pressure permits the forces exerted by the inert gas and the spring to separate the two halves 31*a* and 31*b* of the shell, thus increasing the volume of the buoy without increasing its weight, thereby increasing the buoyancy of the buoy. The separation of the shells and increase in buoyancy continues until the buoy surfaces. The buoy's center of gravity CG is located so that the buoy will float on the surface with a predetermined orientation. As the buoy expands, the internal pressure decreases. This decrease of internal pressure establishes a small differential pressure between the internal gas pressure and the external water pressure that is relatively constant as the buoy ascends to and through the surface. The bellows 33 is constructed to be sufficiently rigid to resist bulging when subjected to this small differential pressure.

When the buoy 30 is pulled beneath the surface by the tether 43, the pressure on the two halves 31*a* and 31*b* force the bellows 33, spring 39, and inert gas to compress and reduce the volume of the buoy. This decrease in volume reduces the buoyancy of the buoy and allows the tether to draw the buoy further beneath the surface with a minimum of force. As the buoy 30 descends the separation between the two shell halves continues to decrease until, at the predetermined launch depth, the two halves 31*a* and 31*b* make contact as shown in FIG. 3.

While the invention has been described in its preferred embodiments, it is to be understood that the words which have been used are words of description rather than limitation and that changes within the purview of the appended claims may be made without departure from the true scope and spirit of the invention in its broader aspects.

We claim:

1. A variable buoyancy buoy including an incompressible shell, having an external surface and an internal area, and an expansion apparatus, constructed and arranged to be compressed at a predetermined depth below a water surface and to expand with decreasing water pressure at depths above said predetermined depth, said expansion apparatus comprising:

an elastic collar covering a selected area of said shell and externally attached to said shell in a watertight manner to form a watertight internal region, said selected area having perforations which extend through said shell from said surface to said internal area, said internal area being said internal region when said elastic collar is collapsed about said external surface at said predetermined depth; and an inert gas contained in said internal region at a pressure equal to water pressure exerted on said shell at said predetermined depth said perforations in said selected area allowing said inert gas to flow therethrough from said internal area to said elastic collar when water pressure is less than pressure exerted by said inert gas, thereby causing said elastic collar to expand creating an area between said surface and said elastic collar, which in combination with said internal area forms said internal region.

2. A variable buoyancy buoy comprising:

a shell having first and second sections; and an expansion apparatus combined with said shell to form a watertight assembly having an internal region, said expansion apparatus constructed and arranged to be compressed at a predetermined depth below a water surface and to expand with decreasing water pressure at depths above said predetermined depth, said expansion apparatus including:

a bellows positioned between said first and second sections and attached to said first and second sections in a watertight manner;

first and second slide channels respectively coupled to said first and second sections in said internal region;

a rod constructed and arranged to slide in said first and second slide channels; and a spring, wrapped about said rod and contained between said first and second slide channels, constructed to provide an internal pressure on said first and second sections equal to water pressure at said predetermined depth.

3. A variable buoyancy buoy in accordance with claim 2 wherein said expansion apparatus further includes an inert gas contained in said internal region at a pressure equal to said water pressure at said predetermined depth.

4. A variable buoyancy buoy in accordance with claim 2 further including a seal positioned between said first and second sections of said shell for providing a watertight seal at depths below said predetermined depths.

* * * * *